US007545264B2

(12) United States Patent
Brecher et al.

(10) Patent No.: US 7,545,264 B2
(45) Date of Patent: Jun. 9, 2009

(54) ALARM SYSTEM WITH ANALOG DEVICES

(75) Inventors: Abraham Brecher, Sparta, NJ (US); Jim Sutton, Lake Hopatcong, NJ (US); Sheila Thornton, Cedar Grove, NJ (US)

(73) Assignee: Tracer Electronics, Lake Hopatcong, NJ (US)

( * ) Notice: Subject to any disclaimer, the term of this patent is extended or adjusted under 35 U.S.C. 154(b) by 380 days.

(21) Appl. No.: 11/505,722

(22) Filed: Aug. 17, 2006

(65) Prior Publication Data

US 2007/0090941 A1 Apr. 26, 2007

Related U.S. Application Data

(60) Provisional application No. 60/729,592, filed on Oct. 24, 2005.

(51) Int. Cl.
*G08B 29/00* (2006.01)

(52) U.S. Cl. ..... 340/506; 340/511; 340/533; 340/541

(58) Field of Classification Search ..... 340/500–524, 340/286.05
See application file for complete search history.

(56) References Cited

U.S. PATENT DOCUMENTS 3,906,437 A * 9/1975 Brandwein et al. ..... 340/945
3,964,302 A * 6/1976 Gordon et al. ..... 73/114.54
4,118,700 A * 10/1978 Lenihan ..... 340/524
4,310,835 A * 1/1982 Sefton ..... 340/533
4,524,349 A * 6/1985 Hyatt ..... 340/500
4,742,334 A 5/1988 Teich et al.
4,751,498 A 6/1988 Shalvi et al.
4,785,285 A 11/1988 Teich et al.
4,991,123 A 2/1991 Casamassima
5,818,334 A 10/1998 Stanley
2005/0072239 A1 * 4/2005 Longsdorf et al. ..... 73/649

* cited by examiner

*Primary Examiner*—Brent Swarthout
(74) *Attorney, Agent, or Firm*—Frishauf, Holtz, Goodman & Chick, P.C.

(57) ABSTRACT

Alarm system includes a controller, a single-wire loop connected to the controller, identification modules connected to the single-wire loop and attachments to or incorporated structures on or in the identification modules. Attachments or incorporated structures include digital and analog devices. Each identification module is programmed to provide a signal or report to the controller indicative of whether the associated device is in a normal state or in an alarm/trouble state. When analog devices are used, the identification modules may be designed not only to convert the analog readings to digital form but also to provide for a permitted range of variation in the sensor readings so that not all variations from a single, predetermined value of the condition being monitored by the sensor are considered indicative of a problem with the area being monitored by the sensor or a fault with the sensor.

20 Claims, 5 Drawing Sheets

ALARM SYSTEM WITH ANALOG DEVICES

CROSS-REFERENCE TO RELATED APPLICATION

This application claims priority of U.S. provisional patent application Ser. No. 60/729,592 filed Oct. 24, 2005, incorporated by reference herein.

FIELD OF THE INVENTION

The present invention relates to alarm systems, and more particularly to alarm systems including identification modules which enable analog-type measurements.

The present invention also relates to single-wire loop alarm systems which enable use of both digital devices such as switches to detect conditions which trigger the alarm as well as analog sensors which can also detect other types of conditions which trigger the alarm.

BACKGROUND OF THE INVENTION

Alarm systems are known which include a number of switches each connected to an identification module and through common wires to a controller. The controller is capable of determining which switches are tripped or malfunctioning by obtaining identification data from the identification module associated with any tripped or malfunctioning switches.

FIG. 5 shows such an alarm system wherein a controller 110 is connected through wires 102, to various digital input identification modules 104, some of which are connected to switches 106, while others are connected to loads 108. One drawback with such an alarm system is that it is limited to switches or other digital devices and does not provide for analog input.

It would be desirable to provide a single-wire loop alarm system which is capable of processing analog input.

OBJECTS AND SUMMARY OF THE INVENTION

It is an object of the present invention to provide new and improved alarm systems, specifically single-wire loop alarm systems.

It is another object of the present invention to provide new and improved identification modules, in particular for a single-wire loop alarm system.

In order to achieve at least one of these objects and possibly others, one embodiment of an alarm system in accordance with the invention includes a controller, a single-wire loop connected to the controller, a plurality of identification modules connected to the single-wire loop and various attachments to or incorporated structures on or in the identification modules. Some attachments or incorporated structures include digital devices such as on/off switches and loads while other attachments are analog devices. Each identification module is programmed to provide a signal or report to the controller indicative of whether the associated device (digital or analog) is in a normal state, i.e., a normal signal, or an alarm/trouble state, i.e., an alarm signal which also serves as a fault signal.

When analog devices are used, the identification modules are preferably designed not only to convert the analog readings from the analog devices to digital form but also to provide for a permitted range of variation in the sensor readings so that not all variations from a single, predetermined value of the condition being monitored by the sensor are considered indicative of a problem with the area(s) being monitored by the sensor or a fault with the sensor. The analog devices may be resistive-type temperature or pressure sensors, sensors which output a voltage or switches arranged in a current loop.

In one embodiment, the devices are motion detectors and the identification modules determine the condition of the motion detectors and report to the controller if the motion detectors are in a normal state, i.e., motion has not been detected, or if the motion detectors are in an alarm/trouble state, i.e., motion has been detected. The determination of the detection of motion may be relative to a threshold so that lack of motion or motion below the threshold is considered a normal state which would cause generation of a normal signal to be provided to the controller and only motion above a threshold is considered an alarm/trouble state which would cause generation of an alarm signal to be provided to the controller.

A combined analog and digital alarm system in accordance with the invention includes a controller, a single-wire loop connected to the controller, and one or more module assemblies connected to the single-wire loop, each including a sensor arranged to generate a non-digital signal representative of a condition in an area being monitored by the sensor and an identification module arranged to convert the non-digital signal into digital form, analyze the converted signal and generate and provide a signal to the controller relating to whether the condition being monitored by the sensor is normal or indicative of a fault with the sensor or an alarm state. The identification module analyzes the converted signal by determining variation of the condition being monitored by the sensor from a permitted range of values, whereby variation within the permitted range causes generation of a normal signal and variation outside of the permitted range causes generation of an alarm signal. The digital aspect of the alarm system involves the presence of one or more alarm assemblies coupled to the single-wire loop, each of which includes a digital-signal generating device, e.g., a switch or a load, and an identification module arranged to generate and provide a signal to the controller indicative of the status of the digital-signal generating device.

A method for monitoring an area in accordance with the invention includes arranging module assemblies at various locations in the area, each module assembly including a sensor arranged to generate a non-digital signal-representative of a condition in the area being monitored by the sensor and an identification module arranged to convert the non-digital signal into digital form, analyze the converted signal and generate a signal relating to whether the condition being monitored by the sensor is normal or indicative of a fault with the sensor or an alarm state, connecting the identification modules to a single-wire loop, connecting the single-wire loop to a controller, and providing the signals from the identification modules to the controller to enable the controller to determine a fault with any sensor or an alarm state detected by any sensor.

In one embodiment, the identification module analyzes the converted signal by determining variation of the condition being monitored by the sensor from a permitted range of values. Variation within the permitted range causes generation of a normal signal and variation outside of the permitted range causes generation of an alarm signal. The permitted range of values of the condition being monitored by the sensor may be adjusted based on actual values of the condition detected by the sensor, values from the sensor averaged over time or known or expected variations in the values in the area being monitored by the sensor.

A module assembly may include a sensor that produces a DC voltage which varies as a function of the condition being monitored by the sensor. In this case, the identification module converts the DC voltage into digital form.

Another form of a module assembly may include a current loop, with the sensor forming a part thereof. In this case, the identification module converts current readings from the current loop into digital form.

When combining the alarm system with digital sensing capabilities, at least one switch assembly is coupled to the single-wire loop, each including a digital device such as an on/off switch or load and an identification module arranged to generate and provide a signal to the controller indicative of the status of the switch or load.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
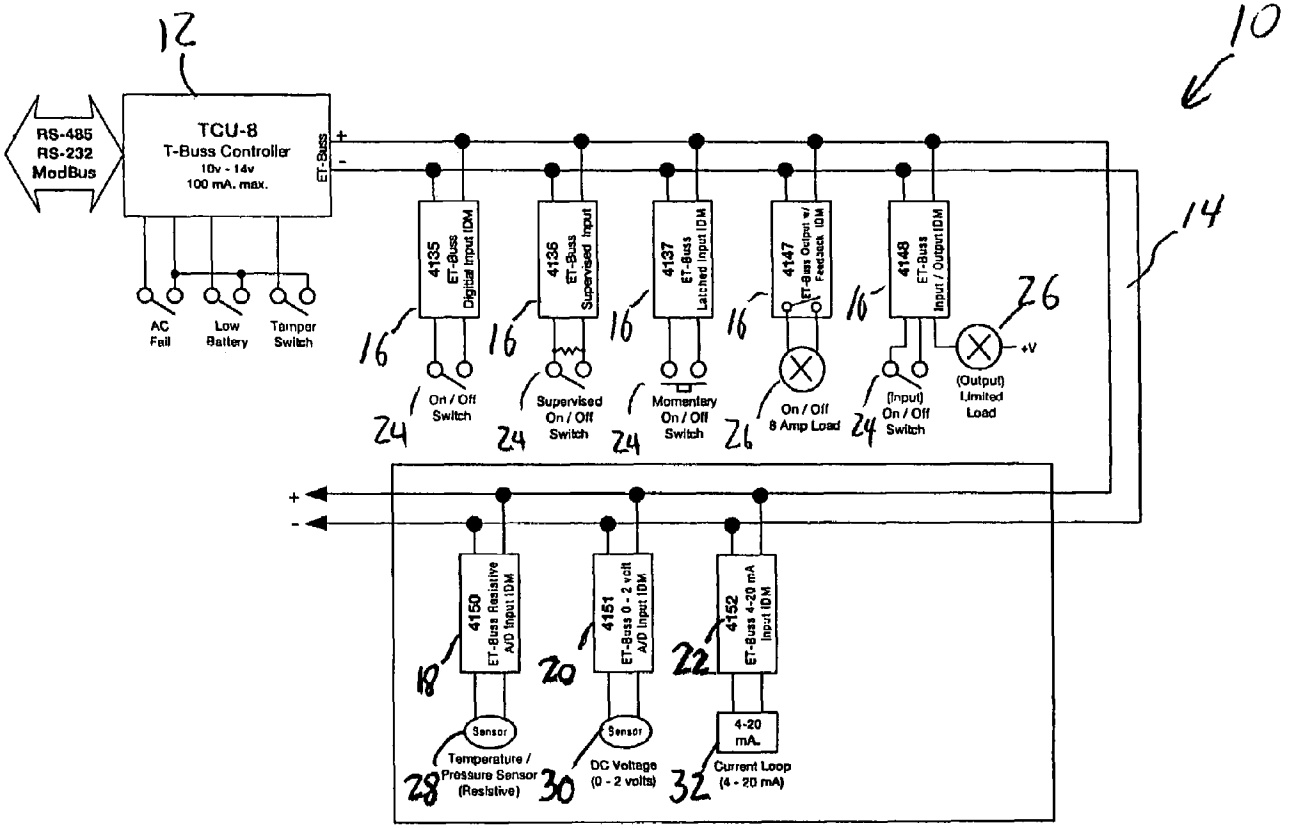
FIG. 1 is a schematic of a single-wire loop alarm system in accordance with the invention.

Referring the accompanying drawings wherein like reference numerals refer to the same or similar elements, an alarm system in accordance with the invention is designated 10 in FIG. 1 and comprises a controller 12, a single-wire loop 14 (which is essentially a pair of wires, one for data and the other for power), a plurality of identification modules 16, 18, 20, 22 (also referred to as IDMs herein) and various attachments to or incorporated structures on or in the identification modules 16, 18, 20, 22. The single-wire loop 14 passes through the area being monitored by the alarm system. Some attachments or incorporated structures include on/off switches 24, e.g., digital switches, and loads 26 which are used in a similar manner as the prior art single-wire loop alarm system shown in FIG. 5.

Figure 5:
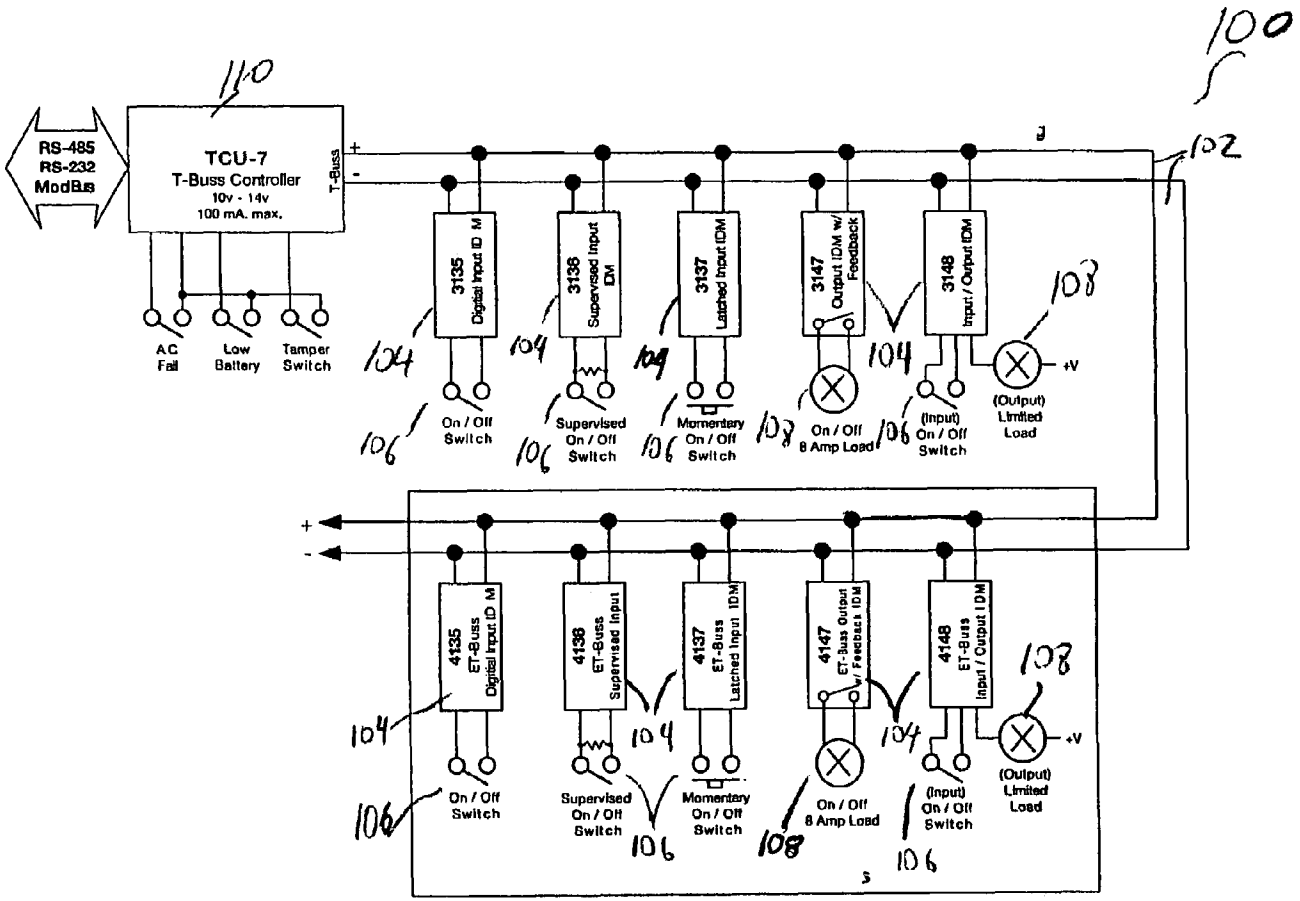
FIG. 5 is a schematic of a prior art single-wire loop alarm system.

In contrast to the alarm system shown in FIG. 5 however, the alarm system 10 in accordance with the invention includes identification module 18 which is associated or integrated with an analog sensor 28 which provides information representative of a condition in an area being monitored by the sensor 28, such as temperature or pressure, and converts analog readings from the sensor 28 into digital form, analyzes them and transmits a signal to the controller 12 based on the analysis. Conversion of the analog readings to digital form may be performed by an analog-to-digital converter resident in the identification module 18, or by any other known conversion device or technique. Analysis of the digital form of the analog readings may be conducted through use of electronic components of the identification module 18 and/or through programming of one or more of the components. The signal from the identification module 18 to the controller 22 may be considered a report on the status of the sensor 28, and may be provided upon request by the controller 22 or automatically at certain times irrespective of a request by the controller 22.

Figure 2:
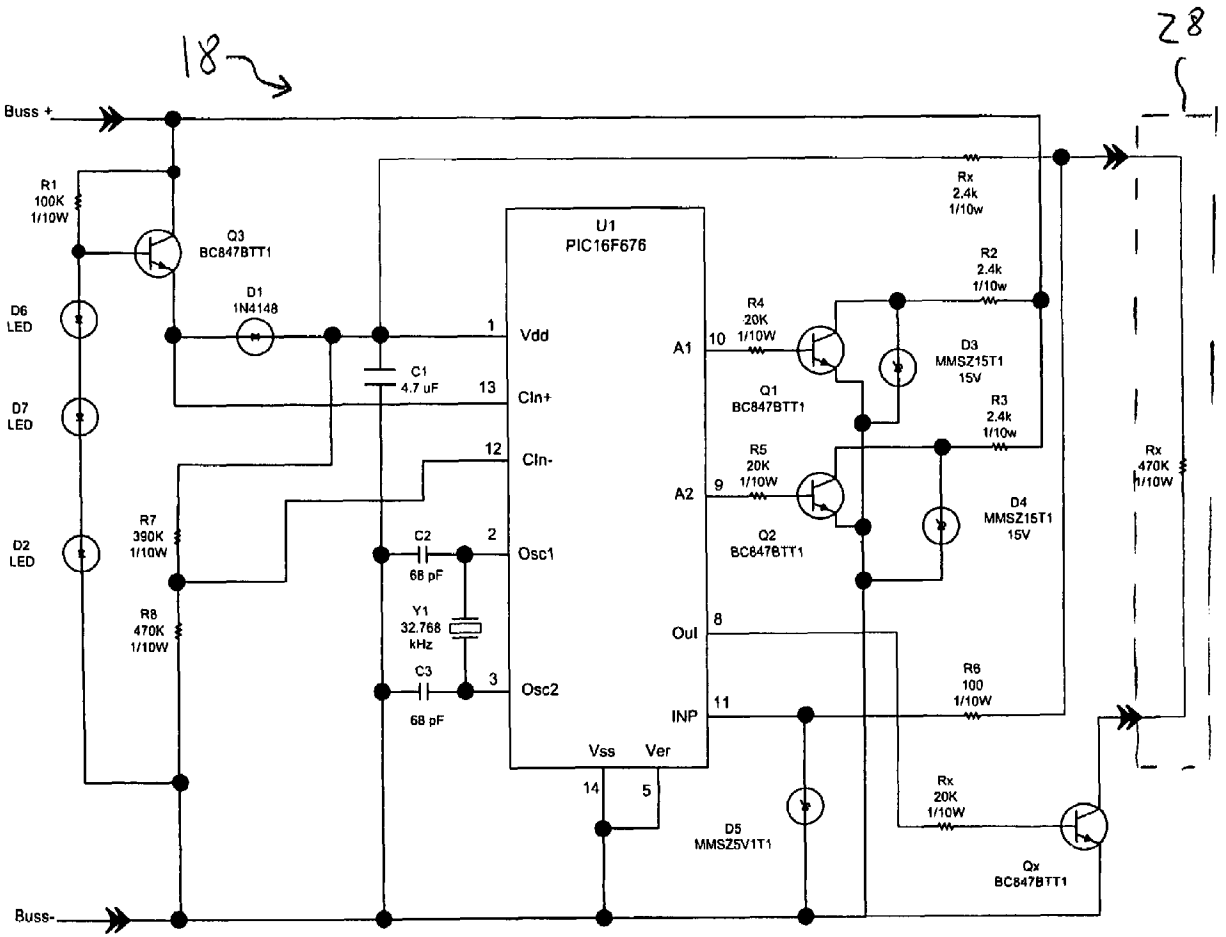
FIG. 2 is a schematic of the identification module (IDM) designated 4150 in FIG. 1.

A schematic of identification module 18 with sensor 28 is shown in FIG. 2, wherein the sensor 28 is represented as a resistive-type sensor. The schematic shows an assembly of electronic components which together enable the conversion of analog signals to digital form, analysis of the converted signals, and transmission or direction of a signal to the controller 12 which will usually vary depending on the analysis. The combination of the identification module 18 and the sensor 28 is referred to as a module assembly. One skilled in the art would be readily able to construct identification module 18 in view of the depiction of the components shown in FIG. 2.

An important advantage of identification module 18 is that it is designed to allow for an internal, pre-determined threshold variation of the readings from sensor 28 before a signal is provided to the controller 12 indicative of a problem with the area being monitored by sensor 28, or a possible fault with the sensor 28. That is, identification module 18 does not simply analyze whether the readings from sensor 28 are above or below a predetermined value, which value would be indicative of a problem or concern with the condition(s) or area(s) being monitored by the sensor 28, and transmit a signal to the controller 12 at that time. Rather, by virtue of the electronic components in identification module 18 and their programming if applicable, identification module 18 is able to monitor the readings from sensor 28, analyze them relative to a predetermined range and then transmits a problem or fault signal (alarm/trouble signal) only when a reading is outside of the range. The predetermined range is adjustable by the user based on, for example, actual readings by the sensor 28, readings from the sensor 28 averaged over time and known or expected variations in the area or condition being monitored by the sensor 28. This adjustment may be performed via the controller 12.

For example, if sensor 28 is a temperature sensor, the identification module 18 can be designed to transmit an alarm signal to the controller 12 only when the temperature is 5 degrees below the expected ambient temperature or 10 degrees above the expected ambient temperature. Thus, a range of permitted variation in the temperature is programmed and/or designed into the identification module 18. Otherwise, if the temperature varies but does not exceed the permitted variation, identification module 18 does not consider the temperature variation to be indicative of a problem with the monitored area or a fault with the sensor 28 (and a normal signal is generated and provided to the controller 12).

In addition to the resistive-type temperature or pressure sensor 28, the illustrated embodiment of alarm system 10 includes identification module 20 which is associated or integrated with a sensor 30 which produces a DC voltage, e.g., in the range of 0-2.0 V or 0-2.5 V. Identification module 20 would then convert the voltage readings from the sensor 30 into digital form, analyze them and transmit a signal to the controller 12 based on the analysis.

Figure 3:
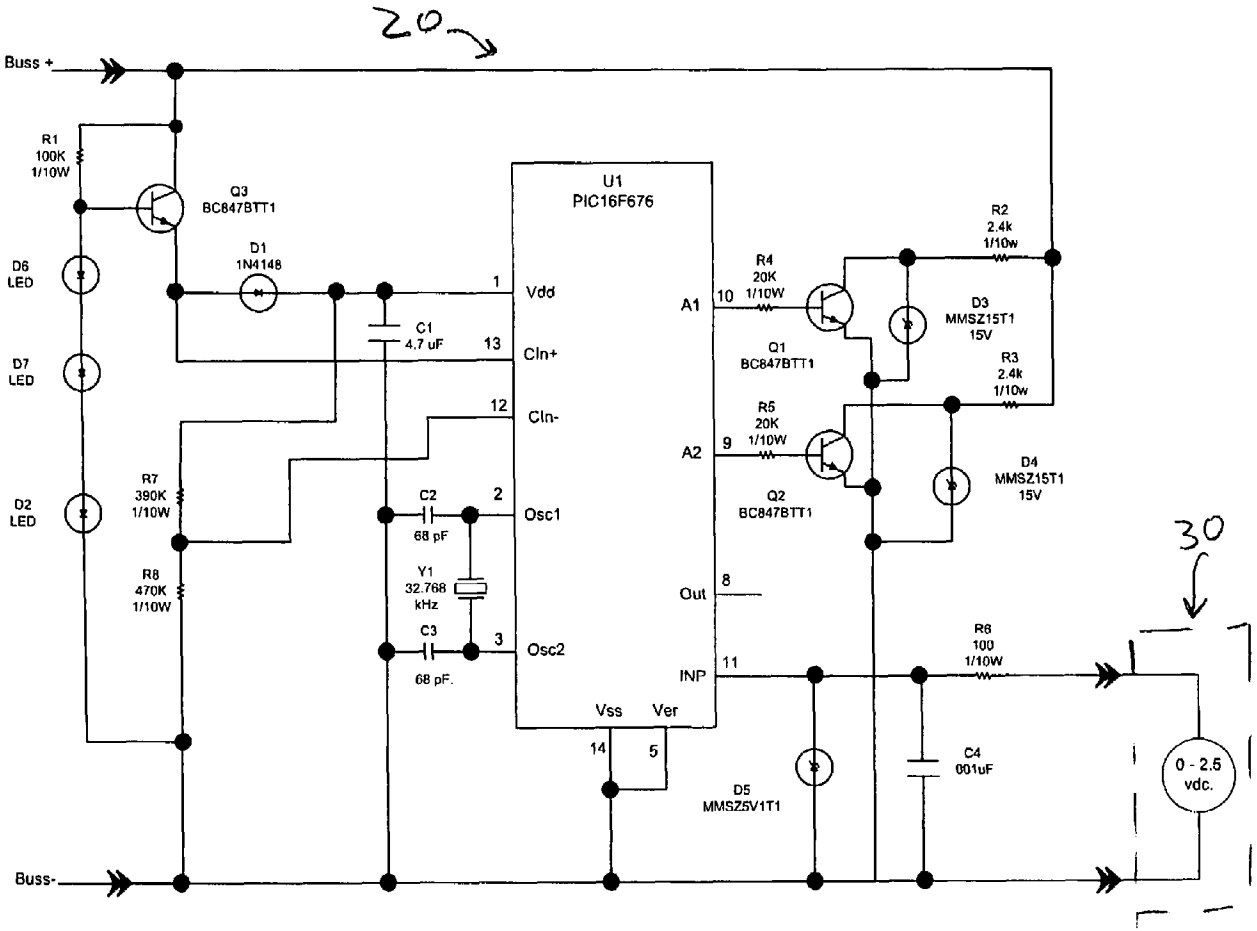
FIG. 3 is a schematic of the IDM designated 4151 in FIG. 1.

A schematic of identification module 20 with sensor 30 is shown in FIG. 3. The schematic shows an assembly of electronic components which together enable the conversion of the DC voltage signals to digital form, analysis of the converted signals, and transmission or direction of a variable signal to the controller 12 depending on the analysis. The signal could be either a signal indicative of a normal state, i.e., a normal signal, or a signal indicative of a fault/trouble state, i.e., an alarm signal. One skilled in the art would be readily able to construct identification module 20 in view of the depiction of the components shown in FIG. 3.

An important advantage of identification module 20 is that it is designed to allow for an internal, pre-determined threshold variation of the readings from sensor 30, in this case, voltage readings, before a signal is sent to the controller 12 indicative of a problem with the condition(s) or area(s) being monitored by sensor 30, or a possible fault with the sensor 30. This threshold-allowance function would be realized in substantially the same manner as identification module 18 is programmed and/or designed to allow for a variation from sensor 28 as described above.

Alarm system 10 also includes identification module 22 which is associated or integrated with a current loop 32 including one or more sensors. In this case, identification module 22 would convert the current readings from the current loop 32 into digital form, analyze them and transmit a signal to the controller 12 based on the analysis.

Figure 4:
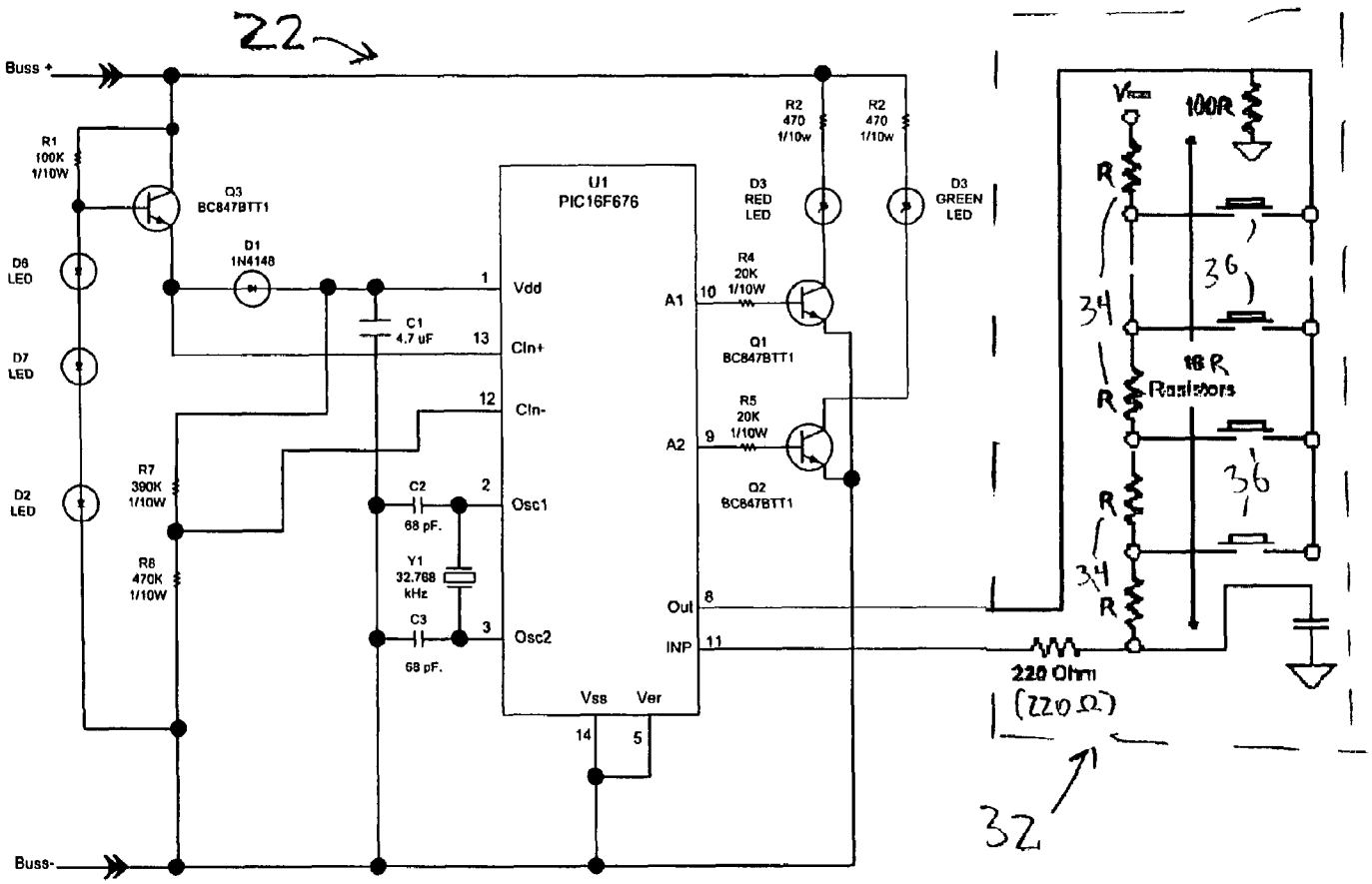
FIG. 4 is a schematic of the IDM designated 4152 in FIG. 1.

A schematic of identification module 22 with current loop 32 is shown in FIG. 4. Current loop 32 is represented as including a number of resistors 34 and switches 36. The schematic shows an assembly of electronic components which together enable the conversion of the current readings to digital form, analysis of the converted readings, and transmission or direction of a variable signal to the controller 12 depending on the analysis. The signal could be either a signal indicative of a normal state, i.e., a normal signal, or a signal indicative of a fault/trouble state, i.e., an alarm signal. One skilled in the art would be readily able to construct identification module 22 in view of the depiction of the components shown in FIG. 4.

An important advantage of identification module 22 is that it is designed to allow for an internal, pre-determined threshold variation of the readings from current loop 32, in this case, current readings, before a signal is sent to the controller 12 indicative of a problem with the area being monitored by current loop 32, i.e., by the switches 36 thereof, or a possible fault with the current loop 32 or a switch 36 thereof. This threshold-allowance function would be realized in substantially the same manner as identification module 18 is programmed and/or designed to allow for a variation from sensor 28 as described above.

Using identification modules 18, 20, 22 and associated analog sensors 28, 30 or switch-containing current loop 32, it is possible to construct a single-wire loop alarm system which is capable of not only detecting tripping of switches but also monitoring physical parameters using analog sensors, such as temperature and pressure sensors. Such a single-wire loop alarm system would therefore include both digital devices and analog devices as shown in FIG. 1.

In one embodiment of the invention, it is possible to vary the thresholds being applied in the identification modules 18, 20, 22. Both the upper and lower permitted variations can be adjusted based for example, on the actual sensor readings, sensor readings averaged over time or known or expected variations in the conditions in the area(s) being monitored. Commands to change the permitted variations could be sent to the identification modules 18, 20, 22 over the loop 14 from the controller 12.

An advantage arising from the electronic components of the alarm system 10 in accordance with the invention is that it is possible for the identifications modules 16, 18, 20, 22 and associated attachments to be situated up to 6000 feet from the controller 12.

Identification modules 16, 18, 20, 22 are addressable so that controller 12 is able to receive signals from the identification modules 16, 18, 20, 22 and, knowing the location of the identification modules 16, 18, 20, 22 and what they are monitoring, it can provide a meaningful report on the status of the area, being monitored. The status might be that the area is too hot, when a temperature sensor is part of a module assembly, or that there is motion in the area, when a motion detector is part of the module assembly.

In one embodiment of an alarm system in accordance with the invention, a plurality of module assemblies are provided, each containing one or more motion detectors. In a home or business sought to be protected by the alarm system, the motion detectors are arranged to monitor various locations, in particular strategic locations through which a person is most likely to walk. Identification modules are placed next to the motion detectors and adjusted to determine their sensitivity in determining the status of the area being monitored by the motion detector. As noted above, the identification modules can be programmed and/or designed with thresholds so that, in use with motion detectors, a certain amount of detected motion will be permitted, i.e., will not cause generation of an alarm signal to the controller. Adjustment of the sensitivity of the identification modules therefore constitute a determination of how much motion should be required in order to trigger an alarm signal. This type of system is particularly advantageous for homes with pets wherein the identification modules can be adjusted to require a larger amount or degree of motion than that provide by the pet so that the pet will not trigger an alarm/trouble signal.

While a particular embodiment of the invention has been shown and described, it will be obvious to those skilled in the art that changes and modifications may be made without departing from the invention in its broader aspects, and, therefore, the aim of this application is to cover all such changes and modifications as fall within the true spirit and scope of the invention. For example, although three different types of sensors which generate non-digital signals are disclosed above in the illustrated embodiment of an alarm system, an alarm system in accordance with the invention may include only one of these types of sensors, or only two types of these sensors. The number and type of sensors in an alarm system can be tailored to the area being monitored by the alarm system.

The invention claimed is:

1. An alarm system comprising:

a controller;

a single wire loop connected to said controller; and a plurality of module assemblies, each independently connected to said single wire loop, each of said module assemblies including a sensor arranged to generate a non-digital signal representative of a condition in an area being monitored by said sensor and an identification module arranged to convert the non-digital signal generated by said sensor into digital form, analyze the converted signal and generate and provide a signal to said controller relating to whether the condition being monitored by said sensor is normal or indicative of a fault with said sensor or an alarm state, the signal being provided from said identification module in each of said module assemblies to said controller via the independent connection of said module assembly to said single wire loop.

2. The alarm system of claim 1, wherein in at least one of said module assemblies, said sensor is attached to said identification module.

3. The alarm system of claim 1, wherein in at least one of said module assemblies, said sensor is incorporated on or in said identification module.

4. The alarm system of claim 1, wherein in at least one of said module assemblies, said identification module analyzes the converted signal by determining variation of the condition being monitored by said sensor from a permitted range of values, whereby variation within the permitted range causes generation of a normal signal and variation outside of the permitted range causes generation of an alarm signal.

5. The alarm system of claim 4, wherein said identification module in said at least one module assembly is adjustable to enable different permitted ranges of values of the condition being monitored by said sensor.

6. The alarm system of claim 5, wherein the adjustment of said identification module in said at least one module assembly is based on actual values of the condition detected by said sensor in said at least one module assembly, values from said sensor in said at least one module assembly averaged over time or known or expected variations in the values in the area being monitored by said sensor in said at least one module assembly.

7. The alarm system of claim 4, wherein said identification module in said at least one module assembly is controllable by said controller to change the permitted range of values.

8. The alarm system of claim 1, wherein said sensor in at least one of said module assemblies is a pressure sensor.

9. The alarm system of claim 1, wherein said sensor in at least one of said module assemblies is a temperature sensor.

10. The alarm system of claim 1, further comprising at least one switch assembly coupled to said single wire loop, each of said at least one switch assembly including a digital on/off switch and an identification module arranged to generate and provide a signal to said controller indicative of the status of said switch.

11. The alarm system of claim 1, wherein said sensor in at least one of said module assemblies is arranged to produces a DC voltage which varies as a function of the condition being monitored by said sensor.

12. The alarm system of claim 1, wherein said sensor in at least one of said module assemblies is part of a current loop and said identification module converts current readings from said current loop into digital form.

13. A combined analog and digital alarm system comprising:

a controller;

a single wire loop connected to said controller;

a plurality of module assemblies, each independently connected to said single wire loop, each of said module assemblies including a sensor arranged to generate a non-digital signal representative of a condition in an area being monitored by said sensor and a first identification module arranged to convert the non-digital signal generated by said sensor into digital form, analyze the converted signal and generate and provide a signal to said controller relating to whether the condition being monitored by said sensor is normal or indicative of a fault with said sensor or an alarm state, the signal being provided from said first identification module in each of said module assemblies to said controller via the independent connection of said module assembly to said single wire loop, said first identification module analyzing the converted signal by determining variation of the condition being monitored by said sensor from a permitted range of values, whereby variation within the permitted range causes generation of a normal signal and variation outside of the permitted range causes generation of an alarm signal; and at least one alarm assembly coupled to said single wire loop, each of said at least one alarm assembly including a digital-signal generating device and a second identification module arranged to generate and provide a signal to said controller indicative of the status of said digital-signal generating device.

14. The alarm system of claim 13, wherein said first identification module in at least one of said module assemblies is adjustable to enable different permitted ranges of values of the condition being monitored by said sensor, adjustment of said first identification module in said at least one module assembly being based on actual values of the condition detected by said sensor, values from said sensor in said at least one module assembly averaged over time or known or expected variations in the values in the area being monitored by said sensor in said at least one module assembly.

15. A method for monitoring an area, comprising:

arranging module assemblies at various locations in the area, each module assembly including a sensor arranged to generate a non-digital signal representative of a condition in the area being monitored by the sensor and an identification module arranged to convert the non-digital signal generated by the sensor into digital form, analyze the converted signal and generate a signal relating to whether the condition being monitored by the associated sensor is normal or indicative of a fault with the associated sensor or an alarm state;

independently connecting the identification modules to a single wire loop;

connecting the single wire loop to a controller; and providing the signals from the identification modules to the controller via the independent connection of the module assemblies to the single wire loop to enable the controller to determine a fault with any sensor or an alarm state detected by any sensor.

16. The method of claim 15, wherein each identification module analyzes the converted signal by determining variation of the condition being monitored by the associated sensor from a permitted range of values, whereby variation within the permitted range causes generation of a normal signal and variation outside of the permitted range causes generation of an alarm signal.

17. The method of claim 16, further comprising adjusting the permitted range of values of the condition being monitored by each sensor based on actual values of the condition detected by the sensor, values from the sensor averaged over time or known or expected variations in the values in the area being monitored by the sensor.

18. The method of claim 15, wherein at least one of the sensors is arranged to produce a DC voltage which varies as a function of the condition being monitored by the sensor and the identification module converts the DC voltage into digital form.

19. The method of claim 15, wherein at least one of the sensors is part of a current loop and the identification module converts current readings from the current loop into digital form.

20. The method of claim 15, further comprising coupling at least one switch assembly to the single wire loop, each of the at least one switch assembly including a digital on/off switch and an identification module arranged to generate and provide a signal to the controller indicative of the status of the switch.

* * * * *